US008985579B1

(12) United States Patent
Juan et al.

(10) Patent No.: US 8,985,579 B1
(45) Date of Patent: Mar. 24, 2015

(54) PAPER FEEDING DEVICE

(71) Applicant: Foxlink Image Technology Co., Ltd., New Taipei (TW)

(72) Inventors: Chun Chia Juan, New Taipei (TW); Te You Chu, New Taipei (TW)

(73) Assignee: Foxlink Image Technology Co., Ltd, New Taipei (TW)

( * ) Notice: Subject to any disclaimer, the term of this patent is extended or adjusted under 35 U.S.C. 154(b) by 0 days.

(21) Appl. No.: 14/278,668

(22) Filed: May 15, 2014

(51) Int. Cl.
*B65H 5/34* (2006.01)

(52) U.S. Cl.
CPC ..... *B65H 5/34* (2013.01); *B65H 2513/10* (2013.01)
USPC ..... 271/270; 271/265.01; 271/272

(58) Field of Classification Search
CPC ..... B65H 29/68; B65H 2513/10; B65H 5/34; B65H 5/062; B65H 2511/22
USPC ..... 271/270, 265.01, 264, 272
See application file for complete search history.

(56) References Cited

U.S. PATENT DOCUMENTS 6,685,184 B2 * 2/2004 Tufekci et al. ..... 271/270
8,020,864 B1 * 9/2011 Tharayil et al. ..... 271/270

FOREIGN PATENT DOCUMENTS

JP 05043085 A * 2/1993 ..... B65H 5/06

* cited by examiner

*Primary Examiner* — Prasad Gokhale
(74) *Attorney, Agent, or Firm* — Muncy, Geissler, Olds & Lowe, P.C.

(57) ABSTRACT

A paper feeding device includes a lower housing, an upper housing, a pickup assembly, a separation assembly, a relay assembly, a paper friction mechanism, an elastic element, a paper speed detector, a first paper feeding assembly, a second paper feeding assembly, a transmission assembly, a motor and a control unit. The control unit controls the paper speed detector to detect paper feeding speeds and the paper speed detector sends signals to the control unit for determining paper feeding conditions. The control unit controls the motor to rotate, and the motor drives the pickup assembly, the relay assembly and the first paper feeding assembly to rotate by virtue of the transmission assembly, and the first paper feeding assembly drives the second paper feeding assembly to rotate, the control unit is capable of adjusting rotating speeds of the motor, so that the paper feeding speeds are stabilized.

10 Claims, 8 Drawing Sheets

PAPER FEEDING DEVICE

BACKGROUND OF THE INVENTION

1. Field of the Invention

The present invention generally relates to a paper feeding device, and more particularly to a paper feeding device capable of stabilizing paper feeding speeds and decreasing a manufacturing cost thereof.

2. The Related Art

Referring to FIG. 8, a conventional paper feeding device 100' generally includes a pickup assembly 10', a separation assembly 20' disposed above the pickup assembly 10', a first paper feeding assembly 30' disposed behind the pickup assembly 10', a second paper feeding assembly 40' disposed above the first paper feeding assembly 30', two ultrasonic sensors 50' disposed oppositely and spaced from each other, a signal processor 60' electrically connected between the two ultrasonic sensors 50', a transmission assembly 70' connected with the pickup assembly 10' and the first paper feeding assembly 30', and a motor 80' connected with the transmission assembly 70'.

The paper feeding device 100' defines a paper feeding channel 90'. The motor 80' drives the pickup assembly 10' and the first paper feeding assembly 30' to rotate by virtue of the transmission assembly 70' to make paper 200' fed into the paper feeding channel 90' of the paper feeding device 100'. When the paper 200' is passed through an interval between the two ultrasonic sensors 50', one ultrasonic sensor 50' sends an ultrasonic signal, and the other ultrasonic sensor 50' receives the ultrasonic signal. The signal processor 60' analyzes a size of the ultrasonic signal for determining whether there are multiple pieces of paper 200' fed into the paper feeding channel 90' of the paper feeding device 100'. So the conventional paper feeding device 100' determines an abnormal paper feeding condition.

However, the conventional paper feeding device 100' determines the abnormal paper feeding condition by virtue of the two ultrasonic sensors 50' and the signal processor 60' that increases a manufacturing cost of the paper feeding device 100'. Moreover, the conventional paper feeding device 100' has no way of detecting paper feeding speeds, so the paper feeding speeds are hardly stabilized.

SUMMARY OF THE INVENTION

An object of the present invention is to provide a paper feeding device. The paper feeding device includes a lower housing, an upper housing, a pickup assembly, a separation assembly, a relay assembly, a paper friction mechanism, an elastic element, a paper speed detector, a first paper feeding assembly, a second paper feeding assembly, a transmission assembly, a motor and a control unit. The upper housing is disposed above the lower housing. The upper housing is spaced from the lower housing to form a paper feeding channel between the lower housing and the upper housing. The pickup assembly is disposed to the lower housing. The pickup assembly includes at least one pickup roller, and a top of the pickup roller projects beyond a top surface of the lower housing and being located in the paper feeding channel. The separation assembly is disposed to the upper housing and corresponding to a top of the pickup assembly. The separation assembly includes at least one separation roller, and a bottom of the separation roller projects under a bottom surface of the upper housing and is located in the paper feeding channel. The relay assembly is disposed to the lower housing, and is located to a downstream of the pickup assembly and the separation assembly which are partially located in the paper feeding channel. The relay assembly includes a relay roller, and a top of the relay roller projects beyond the top surface of the lower housing and being located in the paper feeding channel. The paper friction mechanism is slidably disposed to the upper housing and corresponding to a top of the relay assembly, and is located to the downstream of the pickup assembly and the separation assembly which are partially located in the paper feeding channel. The elastic element is elastically disposed between the upper housing and a top of the paper friction mechanism. The paper speed detector is fastened to the upper housing and is located in front of the paper friction mechanism. The first paper feeding assembly is disposed to the lower housing and is located to a downstream of the relay assembly and the paper friction mechanism which are partially located in the paper feeding channel. The first paper feeding assembly includes at least one feeding roller, and a top of the feeding roller projects beyond the top surface of the lower housing and being located in the paper feeding channel. The second paper feeding assembly is disposed to the upper housing and corresponding to a top of the first paper feeding assembly, and is located to the downstream of the relay assembly and the paper friction mechanism which are partially located in the paper feeding channel. The second paper feeding assembly includes at least one idle roller, and a bottom of the idle roller projects under the bottom surface of the upper housing and is located in the paper feeding channel. The transmission assembly is connected with the pickup assembly, the relay assembly and the first paper feeding assembly. The motor is connected with the transmission assembly. The control unit is connected with the paper speed detector and the motor. The control unit controls the paper speed detector to detect paper feeding speeds and the paper speed detector sends signals to the control unit for determining paper feeding conditions. The control unit controls the motor to rotate, and the motor drives the pickup assembly, the relay assembly and the first paper feeding assembly to rotate by virtue of the transmission assembly, and the first paper feeding assembly drives the second paper feeding assembly to rotate, the control unit is capable of adjusting rotating speeds of the motor, so that the paper feeding speeds are stabilized.

As described above, the paper feeding device determines the paper feeding conditions which include a normal paper feeding condition and an abnormal paper feeding condition by virtue of the control unit controlling the paper speed detector to detect the paper feeding speeds and the paper speed detector sending signals to the control unit so as to decrease a manufacturing cost of the paper feeding device. Furthermore, the control unit of the paper feeding device is capable of adjusting the rotating speeds of the motor, so that the paper feeding speeds are easily stabilized.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
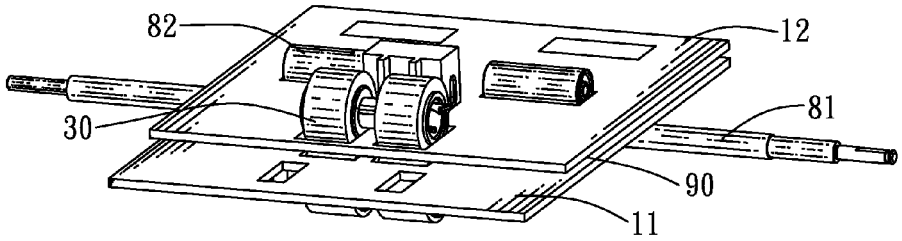
FIG. 1 is a perspective view of a paper feeding device in accordance with an embodiment of the present invention.

With reference to FIG. 1 to FIG. 4, a paper feeding device 100 in accordance with an embodiment of the present invention is shown. The paper feeding device 100 includes a lower housing 11, an upper housing 12, a pickup assembly 20, a separation assembly 30, a relay assembly 40, a paper friction mechanism 50, an elastic element 60, a paper speed detector 70, a first paper feeding assembly 81, a second paper feeding assembly 82, a transmission assembly 101, a motor 102 and a control unit 103.

Figure 3:
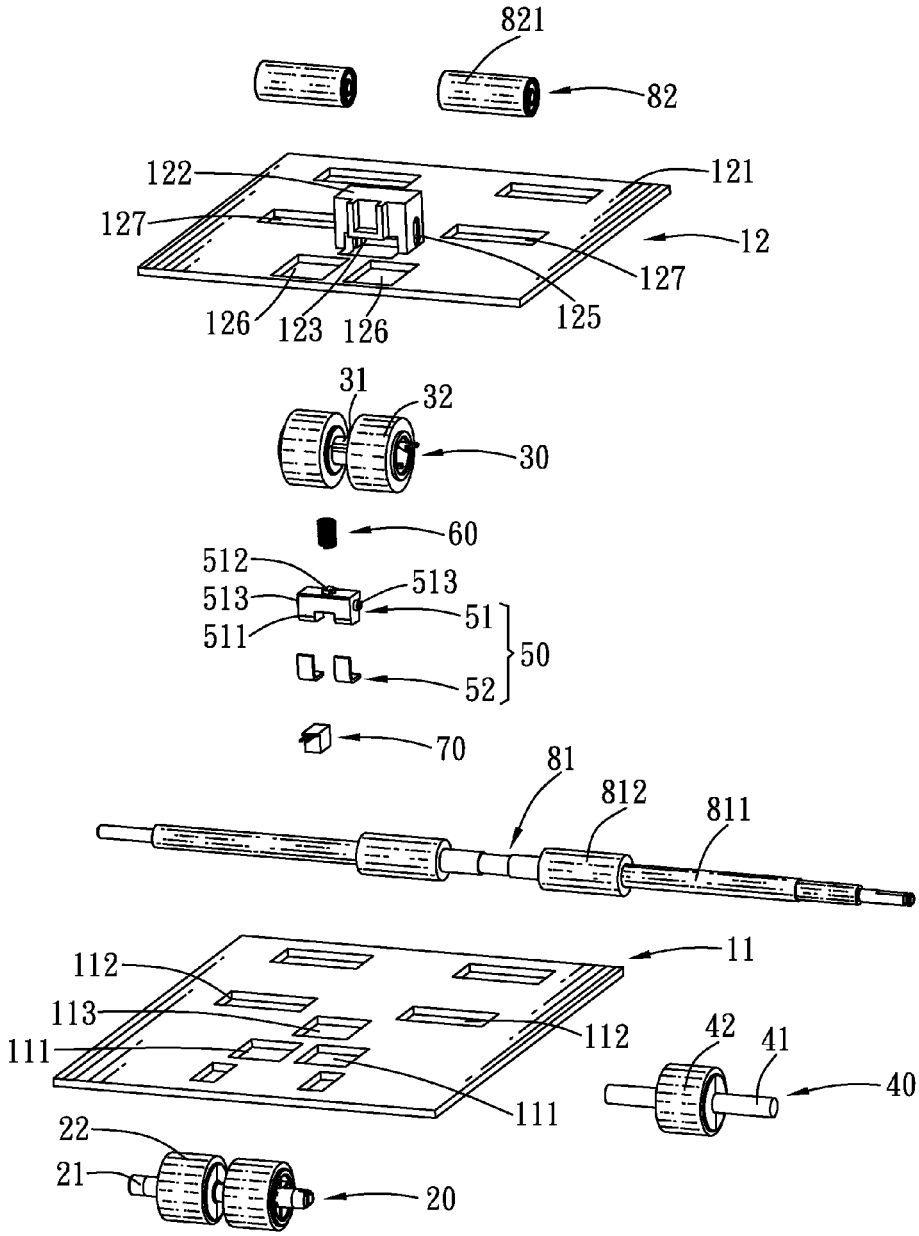
FIG. 3 is an exploded view of the paper feeding device of FIG. 1.

Referring to FIG. 3, the lower housing 11 defines at least one first receiving groove 111, at least one first locating groove 112 disposed behind the first receiving groove 111, and a fastening groove 113 disposed between the first receiving groove 111 and the first locating groove 112. In this embodiment, the lower housing 11 defines two first receiving grooves 111 transversely arranged and spaced from each other, and two first locating grooves 112 transversely arranged and spaced from each other.

Figure 2:
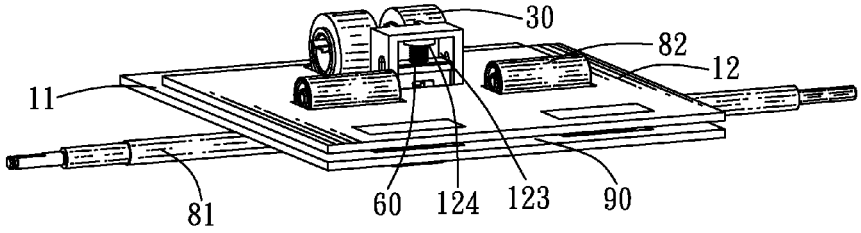
FIG. 2 is another perspective view of the paper feeding device of FIG. 1.

Referring to FIG. 1 to FIG. 3, the upper housing 12 is disposed above the lower housing 11. The upper housing 12 is spaced from the lower housing 11 to form a paper feeding channel 90 between the lower housing 11 and the upper housing 12. The upper housing 12 has a main board 121, and a protruding lump 122 protruding upward from a top of the main board 121. The upper housing 12 defines an accommodating groove 123 penetrating through a front and a rear of the protruding lump 122 and further penetrating downward through a bottom of the protruding lump 122 and the main board 121. An inner surface of a top sidewall of the accommodating groove 123 defines a holding groove 124 communicating with the accommodating groove 123. Two opposite sidewalls of the accommodating groove 123 define two guiding slots 125 vertically extending and transversely penetrating therethrough. The upper housing 12 defines at least one second receiving groove 126, and at least one second locating groove 127 disposed behind the second receiving groove 126. In this embodiment, the upper housing 12 defines two second receiving grooves 126 transversely arranged and spaced from each other, and two second locating grooves 127 transversely arranged and spaced from each other. The second receiving groove 126 is disposed in front of the protruding lump 122, and the second locating groove 127 is disposed behind the protruding lump 122.

Referring to FIG. 1 and FIG. 3, the pickup assembly 20 is disposed to the lower housing 11. The pickup assembly 20 includes a pickup shaft 21, and at least one pickup roller 22 mounted to the pickup shaft 21. In this embodiment, the pickup assembly 20 includes two pickup rollers 22 mounted to the pickup shaft 21. The pickup shaft 21 is located under the lower housing 11. The pickup roller 22 is received in the first receiving groove 111, and a top of the pickup roller 22 projects beyond a top surface of the lower housing 11 and is located in the paper feeding channel 90.

Referring to FIG. 1 and FIG. 3, the separation assembly 30 is disposed to the upper housing 12 and corresponding to a top of the pickup assembly 20. The separation assembly 30 includes a separation shaft 31, and at least one separation roller 32 mounted to the separation shaft 31. In this embodiment, the separation assembly 30 includes two separation rollers 32 mounted to the separation shaft 31. The separation shaft 31 is disposed above the main board 121 of the upper housing 12. The separation roller 32 is received in the second receiving groove 126, and a bottom of the separation roller 32 projects under a bottom surface of the upper housing 12 and is located in the paper feeding channel 90.

Referring to FIG. 1 and FIG. 3, the relay assembly 40 is disposed to the lower housing 11, and is located to a downstream of the pickup assembly 20 and the separation assembly 30 which are partially located in the paper feeding channel 90. The relay assembly 40 includes a relay shaft 41, and a relay roller 42 mounted to the relay shaft 41. The relay shaft 41 is located under the lower housing 11. The relay roller 42 is disposed to the fastening groove 113, and a top of the relay roller 42 projects beyond the top surface of the lower housing 11 and is located in the paper feeding channel 90.

Referring to FIG. 1 to FIG. 4, the paper friction mechanism 50 is slidably disposed to the upper housing 12 and corresponding to a top of the relay assembly 40, and is located to the downstream of the pickup assembly 20 and the separation assembly 30 which are partially located in the paper feeding channel 90. The paper friction mechanism 50 includes a friction bracket 51 and two friction elements 52. The two friction elements 52 are mounted to two opposite sides of a bottom of the friction bracket 51. Each of the friction elements 52 shows an L shape. The friction bracket 51 has a base portion 511. A top of the base portion 511 of the friction bracket 51 protrudes upward to form a buckling portion 512. Two opposite sides of the base portion 511 protrude outward to form two guiding pillars 513. The paper friction mechanism 50 is assembled to a rear of the accommodating groove 123. The guiding pillars 513 are disposed to the guiding slots 125 and capable of sliding upward and downward along the guiding slots 125. The elastic element 60 is elastically disposed between the upper housing 12 and a top of the paper friction mechanism 50. Specifically, the elastic element 60 is elastically disposed between the inner surface of the top sidewall of the accommodating groove 123 and the top of the base portion 511 of the friction bracket 51 of the paper friction mechanism 50. The paper friction mechanism 50 provides a positive force on the relay assembly 40 by virtue of the elastic element 60. Specifically, one end of the elastic element 60 is held in the holding groove 124, and the other end of the elastic element 60 is worn around the buckling portion 512. In this embodiment, the elastic element 60 is a spring.

Referring to FIG. 1 to FIG. 4, the paper speed detector 70 is fastened to the upper housing 12 and is located in front of the paper friction mechanism 50. The paper speed detector 70 is assembled to a front of the accommodating groove 123 with a front end thereof being exposed outside from the front of the accommodating groove 123. In this embodiment, the paper speed detector 70 is an optical sensor.

Referring to FIG. 1 and FIG. 3, the first paper feeding assembly 81 is disposed to the lower housing 11 and is located to a downstream of the relay assembly 40 and the paper friction mechanism 50 which are partially located in the paper feeding channel 90. The first paper feeding assembly 81 includes a feeding shaft 811, and at least one feeding roller 812 mounted to the feeding shaft 811. In this embodiment, the first paper feeding assembly 81 includes two feeding rollers 812 mounted to the feeding shaft 811. The feeding shaft 811 is disposed under a bottom surface of the lower housing 11. The feeding roller 812 is disposed to the first locating groove 112, and a top of the feeding roller 812 projects beyond the top surface of the lower housing 11 and is located in the paper feeding channel 90.

Referring to FIG. 1 and FIG. 3, the second paper feeding assembly 82 is disposed to the upper housing 12 and corresponding to a top of the first paper feeding assembly 81, and is located to the downstream of the relay assembly 40 and the paper friction mechanism 50 which are partially located in the paper feeding channel 90. The second paper feeding assembly 82 includes at least one idle roller 821. In this embodiment, the second paper feeding assembly 82 includes two idle rollers 821. The idle roller 821 is disposed to the second locating groove 127, and a bottom of the idle roller 821 projects under the bottom surface of the upper housing 12 and is located in the paper feeding channel 90.

Figure 4:
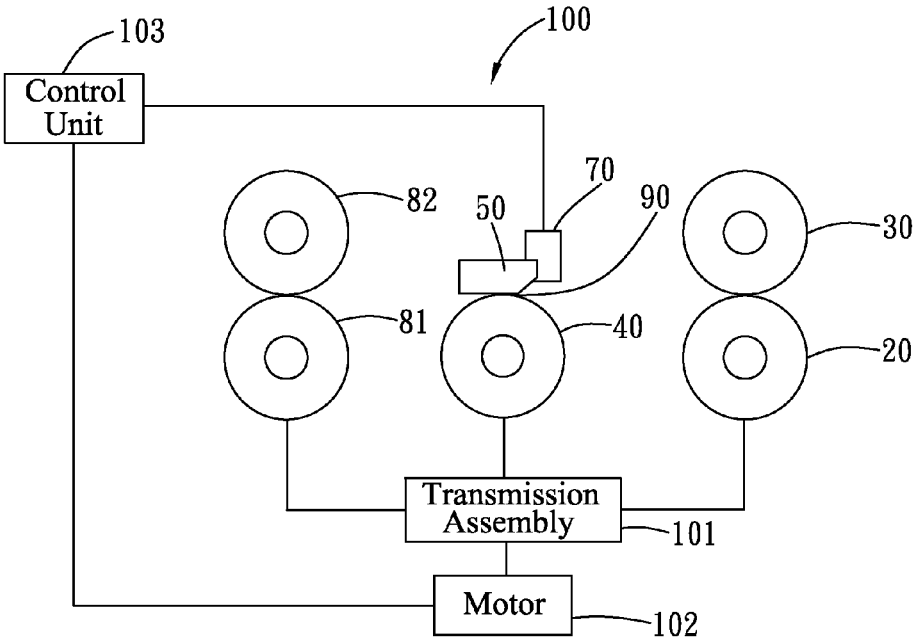
FIG. 4 is a schematic diagram of the paper feeding device of FIG. 1, wherein there is no paper fed into the paper feeding device.
Figure 5:
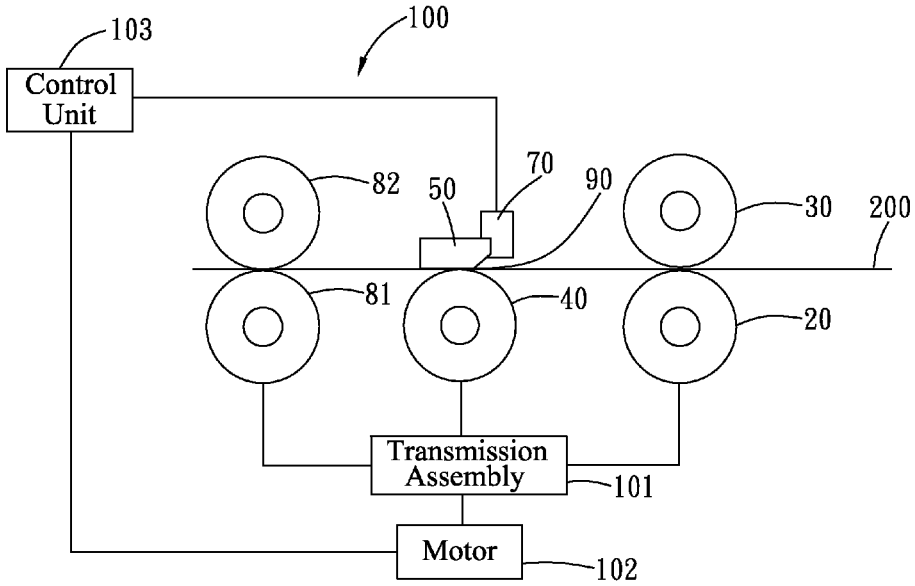
FIG. 5 is a schematic diagram of the paper feeding device of FIG. 1, wherein there is single piece of paper fed into the paper feeding device.
Figure 6:
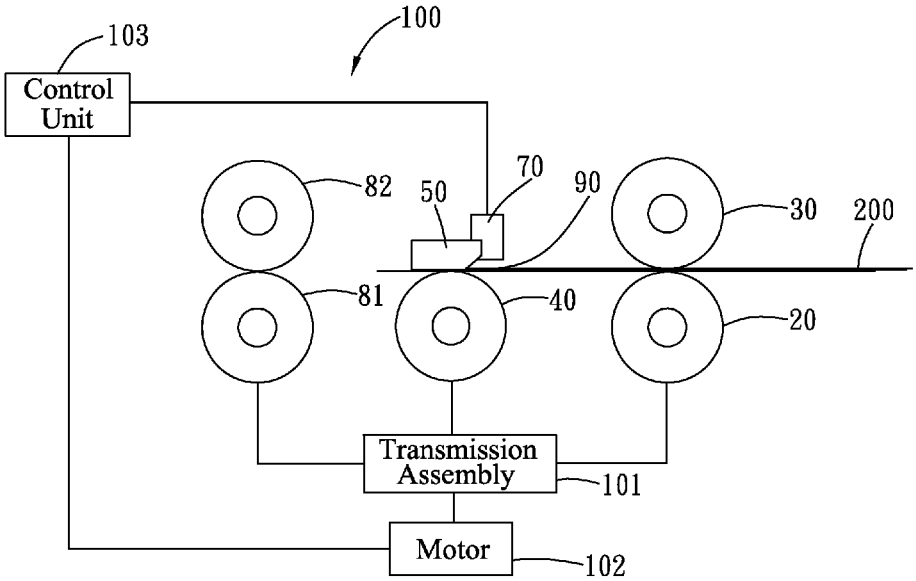
FIG. 6 is a schematic diagram of the paper feeding device of FIG. 1, wherein there are multiple pieces of paper fed into the paper feeding device.
Figure 7:
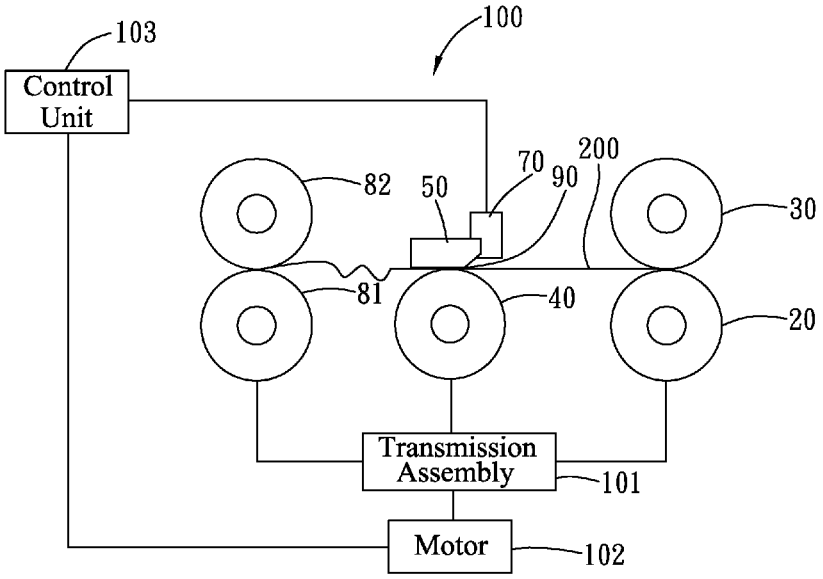
FIG. 7 is a schematic diagram of the paper feeding device of FIG. 1, wherein the paper is jammed.
Figure 8:
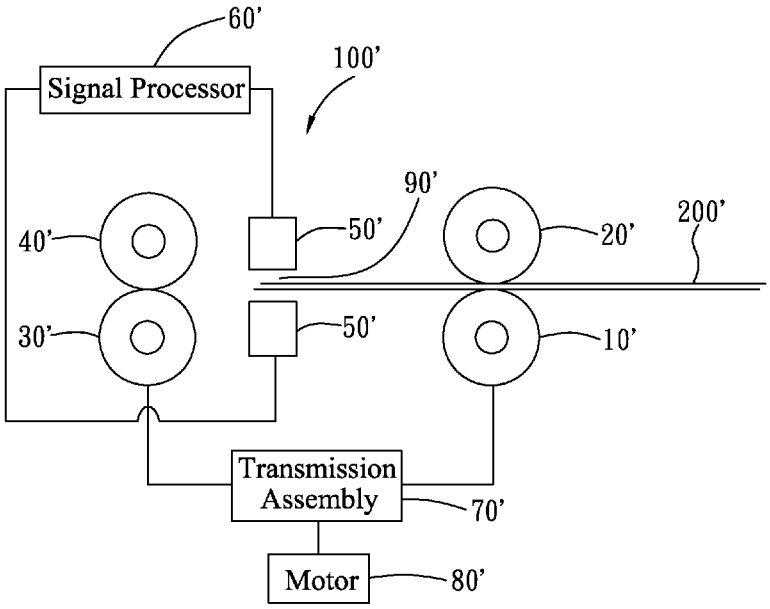
FIG. 8 (Prior Art)
FIG. 8 is a perspective view of a paper feeding device in prior art.

Referring to FIG. 1 and FIG. 4, the transmission assembly 101 is connected with the pickup assembly 20, the relay assembly 40 and the first paper feeding assembly 81. The motor 102 is connected with the transmission assembly 101. The control unit 103 is connected with the paper speed detector 70 and the motor 102. The control unit 103 controls the paper speed detector 70 to detect paper feeding speeds and the paper speed detector 70 sends signals to the control unit 103 for determining paper feeding conditions. So, the paper feeding device 100 determines the paper feeding conditions which include a normal paper feeding condition and an abnormal paper feeding condition by virtue of the control unit 103 controlling the paper speed detector 70 to detect the paper feeding speeds and the paper speed detector 70 sending the signals to the control unit 103. The control unit 103 controls the motor 102 to rotate, and the motor 102 drives the pickup assembly 20, the relay assembly 40 and the first paper feeding assembly 81 to rotate by virtue of the transmission assembly 101, and the first paper feeding assembly 81 drives the second paper feeding assembly 82 to rotate. The control unit 103 of the paper feeding device 100 is capable of controlling the paper speed detector 70 to detect the paper feeding speeds and adjusting rotating speeds of the motor 102, so that the paper feeding speeds are easily stabilized.

Referring to FIG. 1 to FIG. 7, an operating principle of the paper feeding device 100 is described as follows. Paper 200 is placed to a front of the paper feeding device 100, and the paper 200 passes through the pickup assembly 20 and the separation assembly 30 to make the paper 200 feed into the paper feeding channel 90.

When single piece of paper 200 is fed into the paper feeding channel 90 of the paper feeding device 100, the motor 102 drives the relay assembly 40 to rotate clockwise by virtue of the transmission assembly 101. Because a friction force between the relay assembly 40 and the single piece of paper 200 is larger than a friction force between the friction element 52 and the single piece of paper 200, the single piece of paper 200 is brought along by the relay assembly 40 to be fed into the paper feeding device 100 normally, and the single piece of paper 200 can pass through a contact point of the friction element 52 of the paper friction mechanism 50 which contacts the relay assembly 40, at the moment, the control unit 103 controls the paper speed detector 70 to detect the paper feeding speeds to be normal, and the paper speed detector 70 sends a signal to the control unit 103 for determining the normal paper feeding condition. The control unit 103 is capable of adjusting the rotating speeds of the motor 102 so as to stabilize the paper feeding speeds.

When multiple pieces of paper 200 are fed into the paper feeding channel 90 of the paper feeding device 100, the motor 102 drives the relay assembly 40 to rotate clockwise by virtue of the transmission assembly 101. Because a friction force between each two pieces of paper 200 is smaller than a friction force between the friction element 52 and the multiple pieces of paper 200, and a friction force between the relay assembly 40 and the bottommost piece of paper 200 is larger than a friction force between the friction element 52 and the bottommost piece of paper 200, only the bottommost piece of paper 200 is brought along by the relay assembly 40 to be fed into the paper feeding device 100 normally, and the bottommost piece of paper 200 can pass through the contact point of the friction element 52 of the paper friction mechanism 50 which contacts the relay assembly 40. The pieces of paper 200 located on the bottommost piece of paper 200 are blocked by the paper friction mechanism 50 to slow down the paper feeding speed, at the moment, the control unit 103 controls the paper speed detector 70 to detect the paper feeding speeds to be sharply lowered, and the paper speed detector 70 sends another signal to the control unit 103 for determining the abnormal paper feeding condition.

The first paper feeding assembly 81 rotates to bring along the second paper feeding assembly 82 to rotate to further feed the paper 200.

When the paper 200 passes through the relay assembly 40, the paper 200 is jammed, the paper feeding speed is changed on account of the paper 200 bearing a blocking force, the control unit 103 controls the paper speed detector 70 to detect the paper feeding speed to be sharply lowered for determining the abnormal paper feeding condition, so that a detecting function of the paper 200 being jammed is realized.

As described above, the paper feeding device 100 determines the paper feeding conditions which include the normal paper feeding condition and the abnormal paper feeding condition by virtue of the control unit 103 controlling the paper speed detector 70 to detect the paper feeding speeds and the paper speed detector 70 sending signals to the control unit 103 so as to decrease a manufacturing cost of the paper feeding device 100. Furthermore, the control unit 103 of the paper feeding device 100 is capable of adjusting the rotating speeds of the motor 102, so that the paper feeding speeds are easily stabilized.

What is claimed is:

1. A paper feeding device, comprising:

a lower housing;

an upper housing disposed above the lower housing, the upper housing being spaced from the lower housing to form a paper feeding channel between the lower housing and the upper housing;

a pickup assembly disposed to the lower housing, the pickup assembly including at least one pickup roller, and a top of the pickup roller projecting beyond a top surface of the lower housing and being located in the paper feeding channel;

a separation assembly disposed to the upper housing and corresponding to a top of the pickup assembly, the separation assembly including at least one separation roller, and a bottom of the separation roller projecting under a bottom surface of the upper housing and being located in the paper feeding channel;

a relay assembly disposed to the lower housing, and located to a downstream of the pickup assembly and the separation assembly which are partially located in the paper feeding channel, the relay assembly including a relay roller, and a top of the relay roller projecting beyond the top surface of the lower housing and being located in the paper feeding channel;

a paper friction mechanism slidably disposed to the upper housing and corresponding to a top of the relay assembly, and located to the downstream of the pickup assembly and the separation assembly which are partially located in the paper feeding channel;

an elastic element elastically disposed between the upper housing and a top of the paper friction mechanism;

a paper speed detector fastened to the upper housing and located in front of the paper friction mechanism;

a first paper feeding assembly disposed to the lower housing and located to a downstream of the relay assembly and the paper friction mechanism which are partially located in the paper feeding channel, the first paper feeding assembly including at least one feeding roller, and a top of the feeding roller projecting beyond the top surface of the lower housing and being located in the paper feeding channel;

a second paper feeding assembly disposed to the upper housing and corresponding to a top of the first paper feeding assembly, and located to the downstream of the relay assembly and the paper friction mechanism which are partially located in the paper feeding channel, the second paper feeding assembly including at least one idle roller, and a bottom of the idle roller projecting under the bottom surface of the upper housing and being located in the paper feeding channel;

a transmission assembly connected with the pickup assembly, the relay assembly and the first paper feeding assembly;

a motor connected with the transmission assembly; and a control unit connected with the paper speed detector and the motor, the control unit controlling the paper speed detector to detect paper feeding speeds and the paper speed detector sending signals to the control unit for determining paper feeding conditions, the control unit controlling the motor to rotate, and the motor driving the pickup assembly, the relay assembly and the first paper feeding assembly to rotate by virtue of the transmission assembly, and the first paper feeding assembly driving the second paper feeding assembly to rotate, the control unit being capable of adjusting rotating speeds of the motor, so that the paper feeding speeds being stabilized.

2. The paper feeding device as claimed in claim 1, wherein the paper speed detector is an optical sensor.

3. The paper feeding device as claimed in claim 1, wherein the upper housing has a main board, and a protruding lump protruding upward from a top of the main board, the upper housing defines an accommodating groove penetrating through a front and a rear of the protruding lump and further penetrating downward through a bottom of the protruding lump and the main board, the paper friction mechanism is assembled to a rear of the accommodating groove, and the paper speed detector is assembled to a front of the accommodating groove with a front end thereof being exposed outside from the front of the accommodating groove.

4. The paper feeding device as claimed in claim 3, wherein two opposite sidewalls of the accommodating groove define two guiding slots vertically extending and transversely penetrating therethrough, the paper friction mechanism includes a friction bracket, the friction bracket has a base portion, two opposite sides of the base portion protrude outward to form two guiding pillars, the guiding pillars are disposed to the guiding slots and capable of sliding upward and downward along the guiding slots.

5. The paper feeding device as claimed in claim 4, wherein an inner surface of a top sidewall of the accommodating groove defines a holding groove communicating with the accommodating groove, a top of the base portion of the friction bracket protrudes upward to form a buckling portion, one end of the elastic element is held in the holding groove, and the other end of the elastic element is worn around the buckling portion.

6. The paper feeding device as claimed in claim 4, wherein the paper friction mechanism includes two friction elements, the two friction elements are mounted to two opposite sides of a bottom of the friction bracket.

7. The paper feeding device as claimed in claim 6, wherein each of the friction elements shows an L shape.

8. The paper feeding device as claimed in claim 1, wherein the lower housing defines at least one first receiving groove, at least one first locating groove disposed behind the first receiving groove, and a fastening groove disposed between the first receiving groove and the first locating groove, the pickup roller is received in the first receiving groove, the relay roller is disposed to the fastening groove, and the feeding roller is disposed to the first locating groove.

9. The paper feeding device as claimed in claim 1, wherein the upper housing defines at least one second receiving groove, and at least one second locating groove disposed behind the second receiving groove, the separation roller is received in the second receiving groove, and the idle roller is disposed to the second locating groove.

10. The paper feeding device as claimed in claim 1, wherein the elastic element is a spring.

* * * * *